US006401419B1

(12) United States Patent
Béliveau

(10) Patent No.: US 6,401,419 B1
(45) Date of Patent: Jun. 11, 2002

(54) STACKABLE CONSTRUCTION PANEL

(75) Inventor: Jean-Louis Béliveau, Magog (CA)

(73) Assignee: Polyform A.G.P. Inc., Grandby (CA)

( * ) Notice: Subject to any disclaimer, the term of this patent is extended or adjusted under 35 U.S.C. 154(b) by 0 days.

(21) Appl. No.: 09/598,956

(22) Filed: Jun. 22, 2000

(30) Foreign Application Priority Data

Feb. 11, 2000 (CA) ..... 2298170

(51) Int. Cl.[7] ..... E04B 2/28

(52) U.S. Cl. ..... 52/592.6; 52/309.12; 52/426; 52/592.1

(58) Field of Search ..... 52/309.12, 592.5, 52/592.6, 425, 426, 442, 592.1, 309.17

(56) References Cited

U.S. PATENT DOCUMENTS

| | | | | |
|---|---|---|---|---|
| 3,895,469 A | | 7/1975 | Kapitan | |
| 4,229,920 A | | 10/1980 | Lount | |
| 4,706,429 A | | 11/1987 | Young | |
| 4,731,968 A | * | 3/1988 | Obino | 52/309.12 |
| 4,884,382 A | | 12/1989 | Horobin | |
| 4,885,888 A | | 12/1989 | Young | |
| 4,894,969 A | | 1/1990 | Horobin | |
| 5,060,446 A | | 10/1991 | Beliveau | |
| 5,122,015 A | | 6/1992 | Shen | |
| 5,163,261 A | | 11/1992 | O'Neill | |
| 5,428,933 A | | 7/1995 | Philippe | |
| 6,230,462 B1 | * | 5/2001 | Beliveau | 52/426 |

FOREIGN PATENT DOCUMENTS

| | | |
|---|---|---|
| CA | 2142517 | 8/1995 |
| CA | 2256091 | * 12/1998 |
| EP | 0275938 | 7/1988 |

* cited by examiner

*Primary Examiner*—Beth A. Stephan
*Assistant Examiner*—Jennifer I. Thissell
(74) *Attorney, Agent, or Firm*—Robic

(57) ABSTRACT

A stackable insulating foam panel which has a top side and a bottom side. Each of the panels has a median row of alternating projections and recesses with a similar complementary shape. The median row is disposed between two coplanar edge surfaces. Each projection of the top side is opposed to a recess of the bottom side whereby the top side and/or the bottom side of the panel can be interconnected with either the top side or the bottom side of a like panel. The present invention also concerns a wall form assembly which comprises opposed foam panels disposed in parallel relationship to make a wall form for receiving a flowable material such as concrete and a plurality of connectors for tying the opposed foam panels together.

13 Claims, 6 Drawing Sheets

STACKABLE CONSTRUCTION PANEL

FIELD OF THE INVENTION

The present invention relates generally to wall forms of the type comprising pairs of opposed form walls each formed of a plurality of stacked rows of plastic foam panels for receiving flowable materials such as concrete. More particularly, it relates to interlocking foam panels or blocks used to build those form walls.

BACKGROUND OF THE INVENTION

A number of different systems and methods currently exist for making insulating forms for casting a concrete wall. Often, these systems comprise pairs of opposed foam panels generally made of rigid foam like polystyrene, which define concrete-receiving cavities therebetween. Those pairs of foam panels are placed one above the other so to form the wall form. Once the concrete is solidified, the form walls remain in place to insulate the wall. Those form walls are typically maintained in spaced and parallel relationship before the pouring of concrete by means of connectors comprising a pair of parallel lateral attachment flanges each embedded in one of the two opposed foam panels, and a connecting web interconnecting the flanges.

The piling up of such panels is performed on the site of construction. One object in this field is to obtain foam panels that would allow, on one hand, an easy and very rapid piling up without loosing time and, on the other hand, would allow construction of a stable and solid stacking that will not likely disassemble prior to the pouring of concrete. As can be easily understood, as soon as the concrete is poured, the chances that the stack collapses or disassembles is greatly reduced.

An example of a prior art attempt in this field is given in U.S. Pat. No. 5,428,933 which discloses an insulating construction panel having a top and a bottom edge each provided with interconnecting members consisting of at least two rows of alternating projections and recesses. The recesses of one row are adjacent to a projection of the other row, such as a checkerboard, whereby the insulation panel can be interconnected with a like member in a bi-directional or reversible manner. One drawback encounters with such panels is that the projections at the corners and along the edges tend to break easily. Furthermore, when such panel is not very thick, it easily tips over once stacked over a like panel. Other examples of insulating construction panel are shown in U.S. Pat. Nos. 3,895,469; 4,229,920; 4,704,429; 4,884,382; 4,885,888 and 4,894,969.

There is thus still presently a need for an improved insulating construction panel for building form walls.

SUMMARY OF THE INVENTION

An object of the present invention is to propose a stackable insulating foam panel that will satisfy the above-mentioned need, and more particularly to propose an improved stackable foam panel that allows the construction of a stable and solid stack.

In accordance with the present invention, that object is achieved with a stackable insulating foam panel having a top side and a bottom side each including a median row of alternating projections and recesses having a similar complementary shape, the median row being disposed between two coplanar edge surfaces. Each projection of the top side is opposed to a recess of the bottom side whereby the top side and/or the bottom side of the panel can be interconnected with either the top side or the bottom side of a like panel.

The present invention also concerns a wall form assembly comprising opposed foam panels, as described above, disposed in parallel relationship to make a wall form for receiving a flowable material such as concrete and a plurality of connectors for tying the opposed foam panels together. More particularly, the form wall assembly comprises:

- a first and a second opposed foam panels in parallel relationship; and
- a plurality of connectors hingely tying together the first and second foam panels, whereby the tied foam panels are movable between an extended position where the foam panels are spaced-apart to make the form and a collapsed position where the foam panels are brought close to each other.

As can be appreciated, the two coplanar edge surfaces of the foam panel act as shoulders or abutments for the edge surfaces of an interconnected like panel, and thus help to solidify or stabilise a stack built with foam panels according to the present invention.

Other features and objects of the present invention will become more apparent from the description that follows of a preferred embodiment, having reference to the appended drawings and given as examples only as to how the invention may be put into practice.

DESCRIPTION OF A PREFERRED EMBODIMENT

Figure 1:
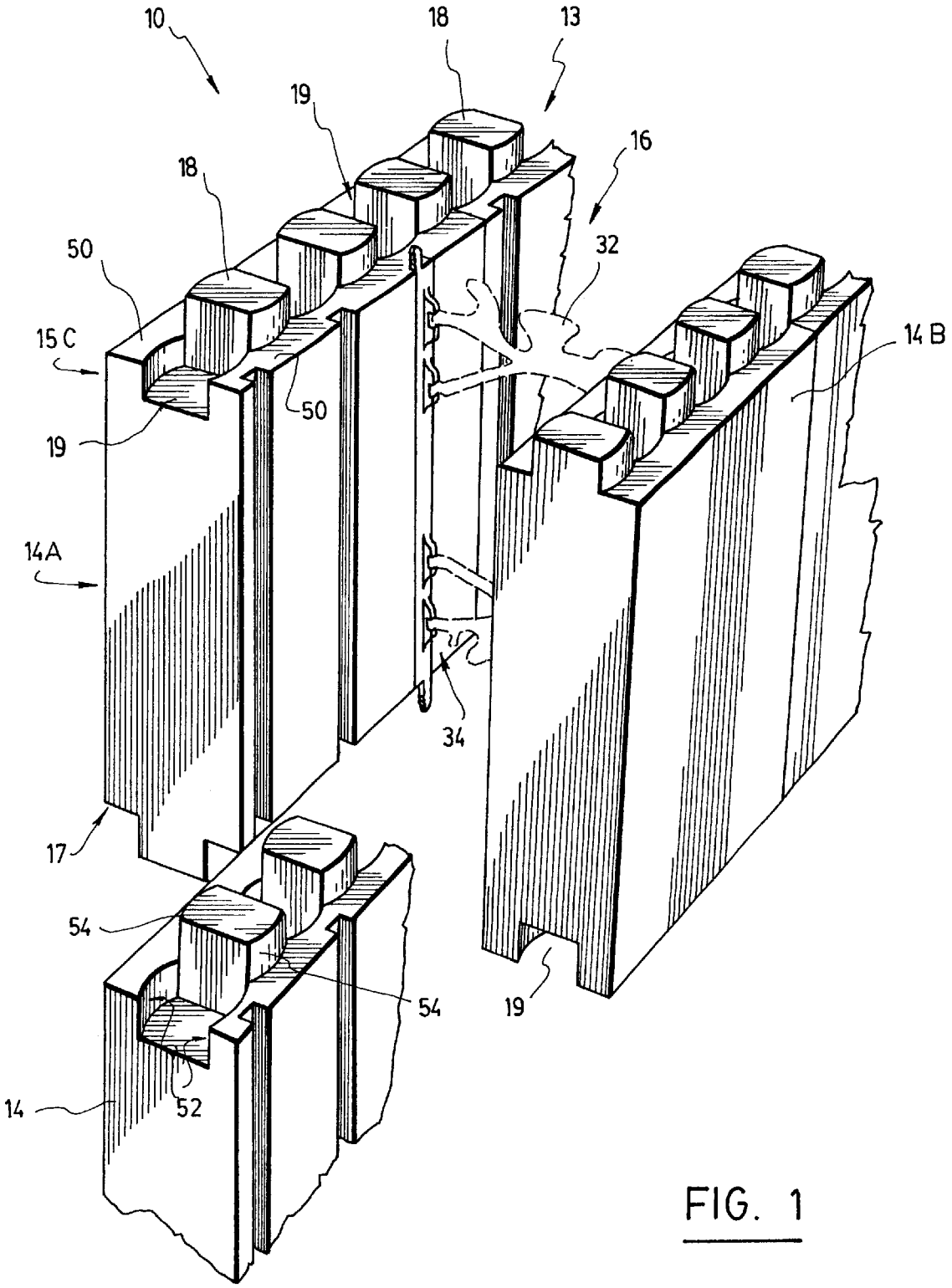
FIG. 1 is a perspective fragmentary view of a form wall assembly according to a preferred embodiment of the present invention.
Figure 4:
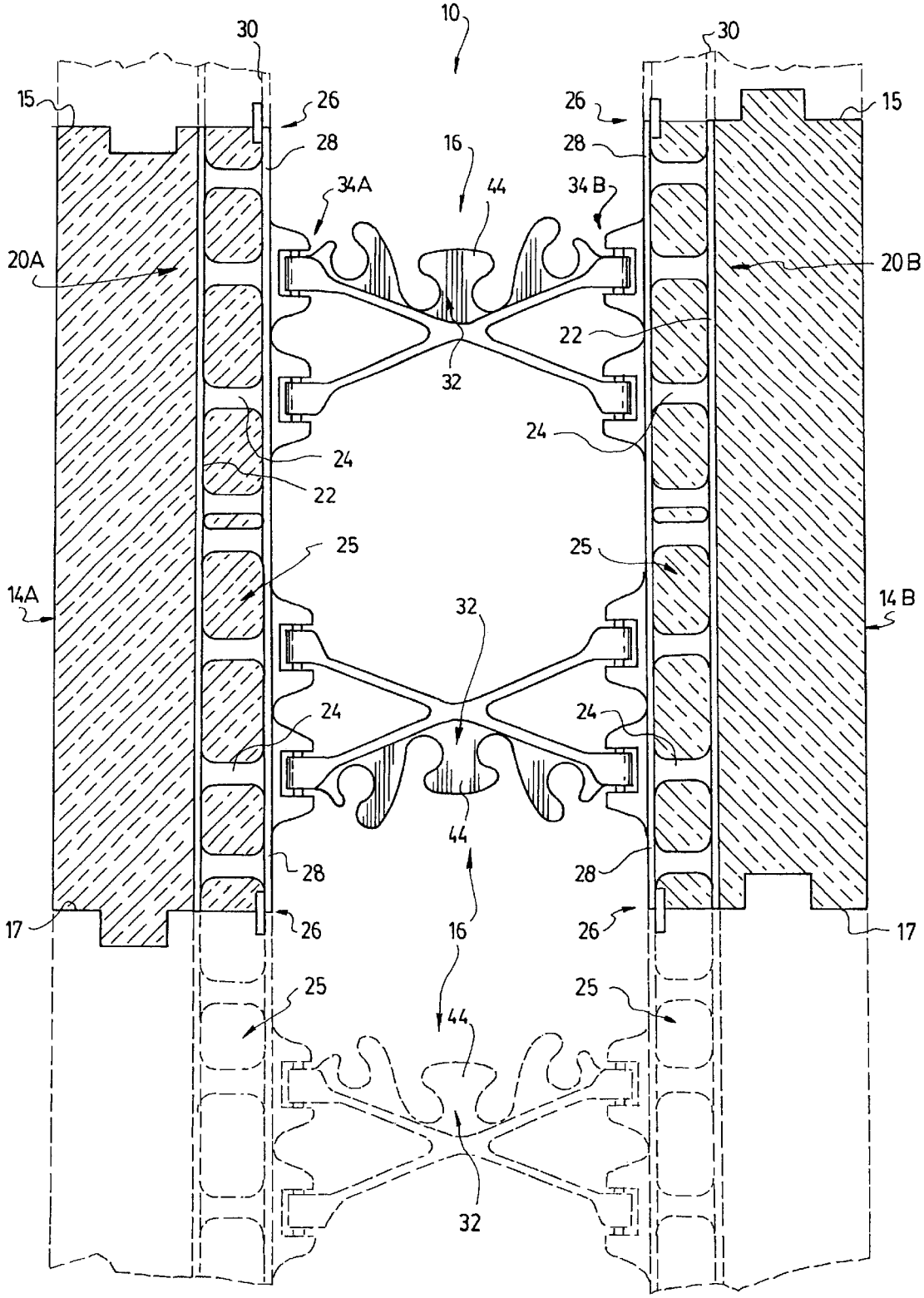
FIG. 4 is a cross-sectional side elevation view of the form wall assembly of FIG. 2 along line IV—IV showing an upper and a lower row of stacked foam panels.

Referring to FIG. 1, a form wall assembly (10) according to the present invention is suitable to make a form for receiving flowable material such as concrete or the like. The form obtained is of the type comprising a plurality of stacked insulating horizontal rows of coplanar substantially rectangular foamed plastic panels (14) abutting one another along horizontal and vertical sides thereof. More particularly, the form wall assembly (10) comprises a first foam panel **(14*a*) opposed to a second foam panel (14*b*) in spaced and parallel relationship, and tied together by means of a plurality of connectors (16), as best seen in FIG. 4. The foam panels (14) are movable between an extended position, as shown in FIG. 1, where the foam panels (14) are spaced-apart to make the form and a collapsed position, not illustrated, where the foam panels (14)** are brought close to each other, mainly for shipping purposes.

Figure 2:
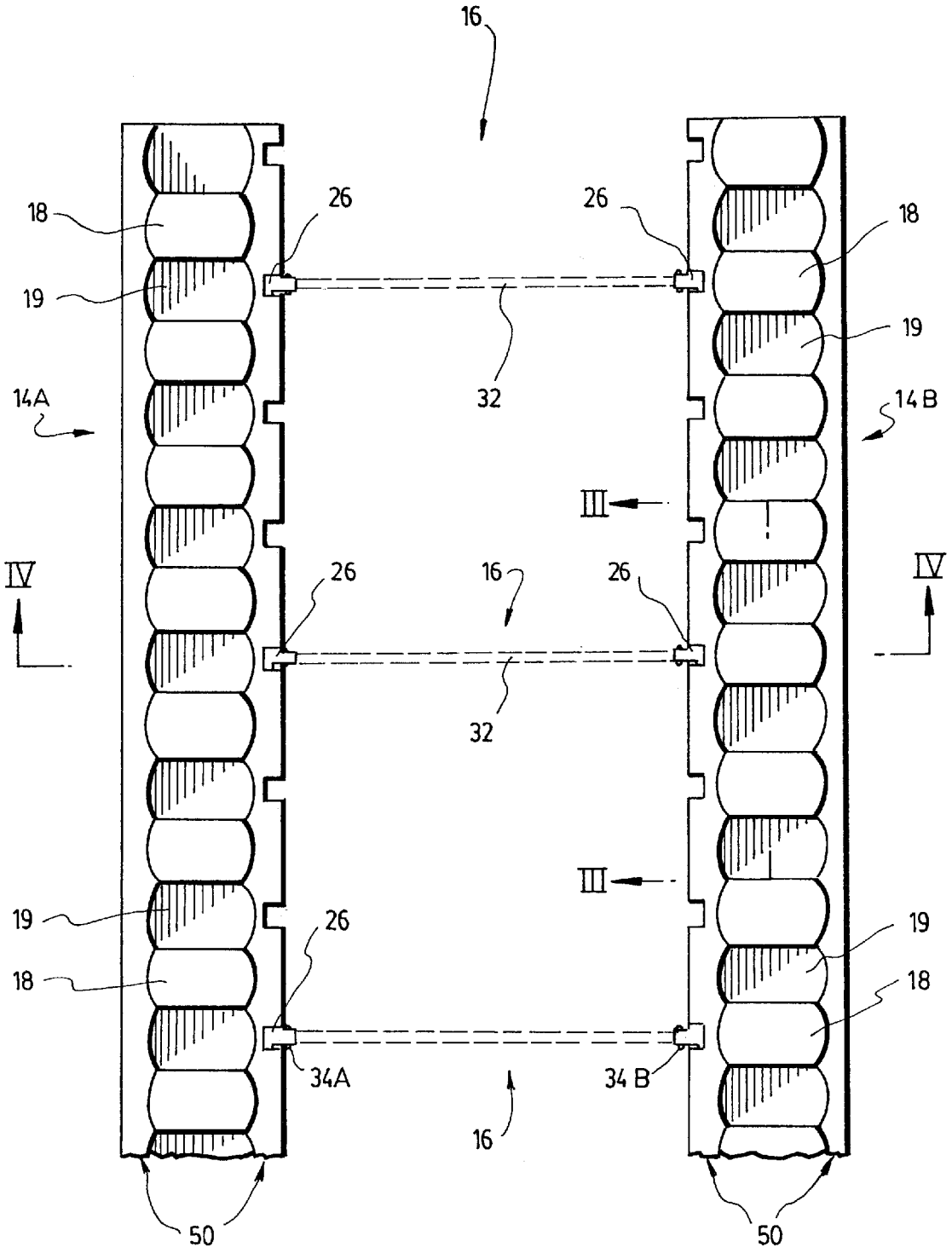
FIG. 2 is a top view of the form wall assembly of FIG. 1 showing the relief of the top side of the foam panels.

The foam panels (14) each have a top side (15) opposite a bottom side (17) and, as illustrated in FIGS. 1 and 2, each of the top side (15) and the bottom side (17) is provided with a median row (13) of alternating projections (18) and recesses (19) having a similar complementary shape. This median row (13) is disposed between two coplanar edge surfaces (50) bordering the edges of the panel (14). It has to be noted that the coplanar edge surfaces (50) are preferably provided with a width sufficiently large so as to offer an increased stability between interlocked panels (14).

Figure 3:
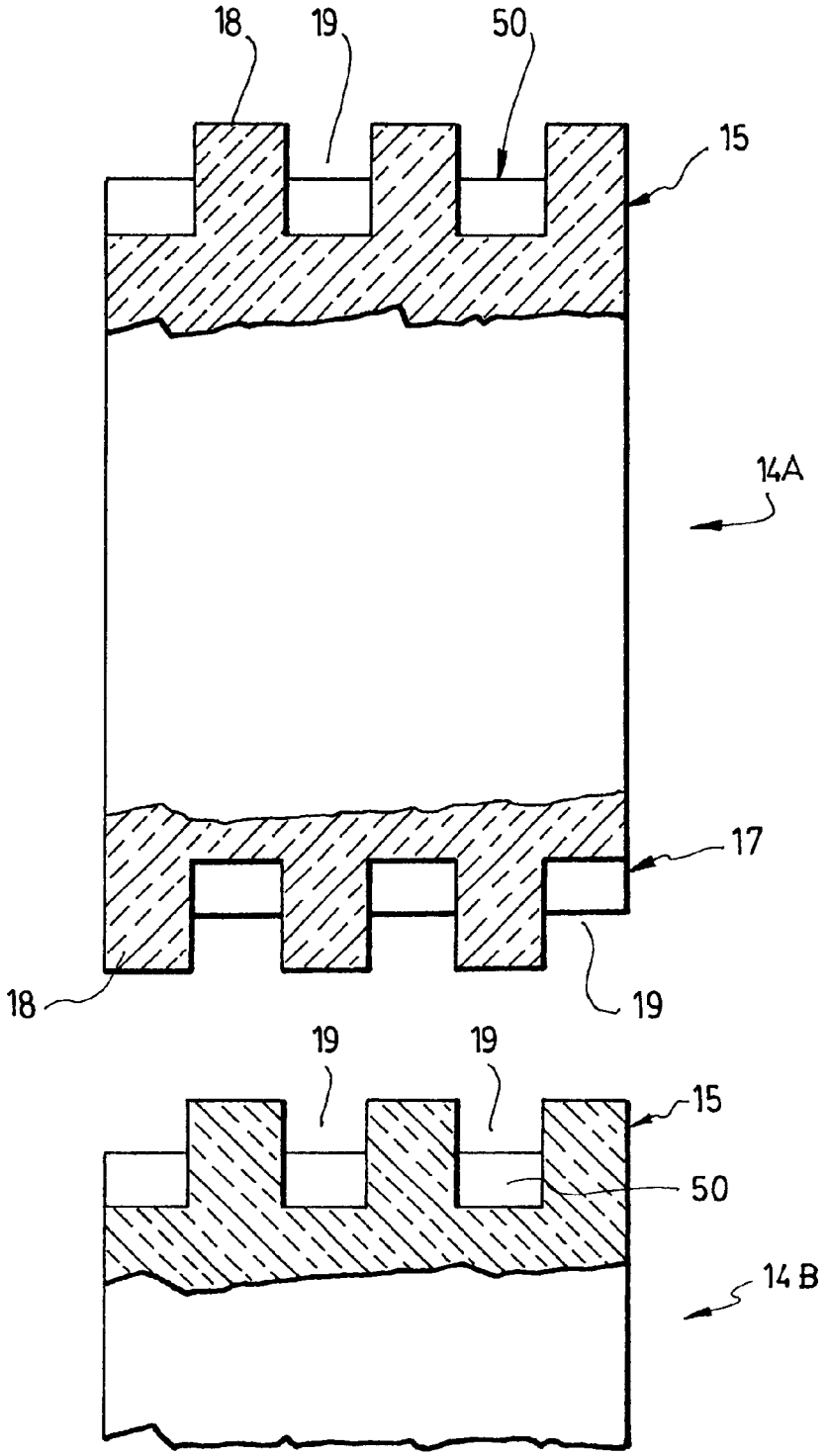
FIG. 3 is a cross-sectional side elevation view of the left panel of the form wall assembly of FIG. 2 along line III—III showing also the top side of a lower panel.

As best seen in FIG. 3, each projection (18) and recess (19) of the top side (15) of one panel (14*a*) is opposed respectively to a recess (19) and a projection (18) of the bottom side (17) of the same panel (14*a*), and is facing respectively a recess (19) and a projection (18) of the top side (15) of the other panel (14*b*), when the pair of panels (14*a* and 14*b*) are in the extended position as in FIGS. 1 or 2, whereby the pair of panels (14*a*, 14*b*) can be interconnected with a like pair of panels.

Mainly because of the manufacturing process, the projections (18) and the recesses (19) are generally rectangular. However, projections and recesses of other shapes such as circular, oblong, square etc. could also be used.

In order to prevent the deterioration of the projection (18), the present invention prefers using projections (18) with rounded-corners. Nevertheless, projections (18) with square-corners or other forms, would still be efficient.

Also preferably, each of the projections (18) and the recesses (19) has two opposite substantially convex lateral sides (52, 54) which help the insertion of the projections (18) in the recesses (19).

Figure 5:
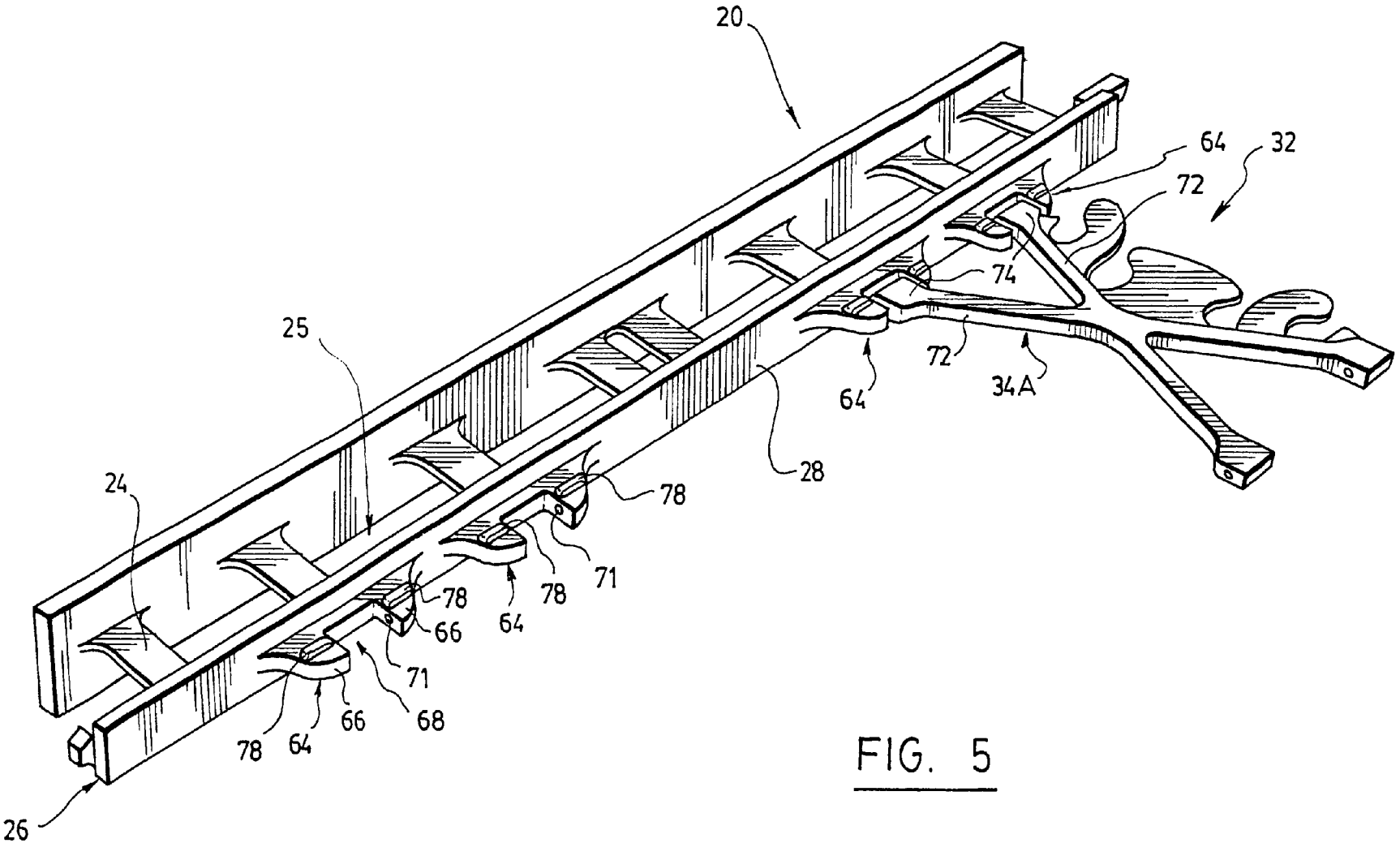
FIG. 5 is a perspective view of a connector according to a preferred embodiment of the invention, shown without its right anchor member and a portion of the web member.

Referring now to FIGS. 4 and 5 and according to a preferred embodiment of the invention, each connector (16) comprises a pair of anchor members (20*a*, 20*b*), a first one (20*a*) embedded in the first foam panel (14*a*) and the second one (20*b*) embedded in the second foam panel (14*b*). Each anchor member (20) has an elongated flange plate (22) extending longitudinally and deep inside the foam panel (14) and an elongated link element (24) connected longitudinally to the flange plate (22) and having a projecting end (26) coming out of the foam panel (14). Preferably, the projecting end (26) of each anchor member (20) comprises a stabilising plate (28) as best shown in FIG. 5 parallel to the flange plate (22) and extending flush with the inner surface (30) of the foam panel (14).

In order to lighten the foam panel assembly, the link element (24) preferably comprises a plurality of holes (25) therealong. However, the link element (24) may also be plane solid.

It has to be noted that by saying that the anchor member (20) is embedded in the foam panel (14), a person in the art will understand that in the making of the foam panel (14) in the manufacturing plant, the plastic foam material forming the panel (14) is injected to surround the anchor member (20), thereby strengthening the joint between the panel (14) and the anchor member (20) which thus act as an anchor forming part of the foam panel (14). More specifically, the plastic foam material, which is preferably polystyrene or any other material known to a person skilled in the field of plastic foam, is injected to surround the anchor member (20).

Referring to FIG. 4, the connector (16) further comprises a web member (32) extending between the foam panels (14). The web member (32) that is preferably made of a relatively flexible plastic comprises a central portion (44) having a shape adapted to receive and hold metal rods used to reinforce the concrete. The web member (32) further has a first longitudinal side end (34*a*) hingedly connected to the projecting end (26) of the first anchor member (20*a*) and a second longitudinal side end (34*b*) opposed to the first longitudinal side end (34*a*). The second longitudinal side end (34*b*) is hingedly connected to the projecting end (26) of the second anchor member (20*b*). The foam panels (14) are movable between an extended position, as shown in FIG. 1, where the foam panels (14) are spaced-apart to make the form and a collapsed position, not illustrated, where the foam panels (14) are brought close to each other, mainly for shipping purposes.

Figure 6:
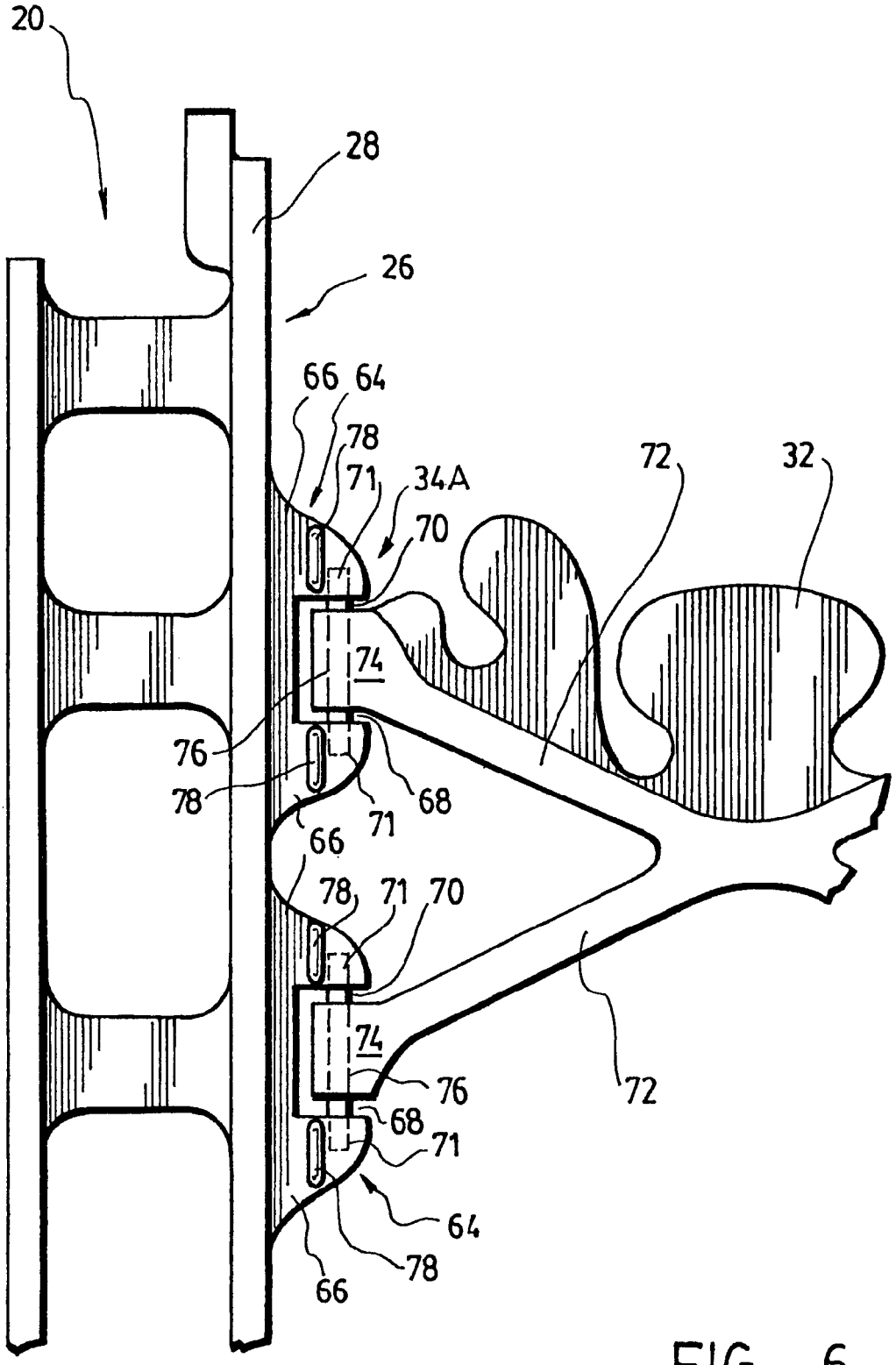
FIG. 6 is a side view in partial transparency of a portion of the connector of FIG. 5.

Referring to FIGS. 5 and 6, a plurality of connecting elements (64) preferably disposed on the stabilising plate (28) of the projecting end (26) of each anchor member (20) in order to hingedly connect the web member (32) to the anchor members (20) is illustrated. Each of these connecting elements (64) is shaped to form two aligned ridges (66) projecting from the stabilising plate (28), and the space between them defined a longitudinal sleeve (68). A joining pin (70) can be mounted in the sleeve (68). Preferably, pin receiving holes (71) are provided in the ridges (66) for this purpose, each hole (71) facing inwardly of the sleeve (68). It will be understood that although the connecting elements are shaped to form two aligned ridges, the present invention contemplates employing other types of connecting elements that would be apparent to a person skilled in the art, such as open slotted tube-like knuckles.

To cooperate with the connecting elements (64), each longitudinal side end (34*a*, 34*b*) of the web member (32) defines a corresponding number of arms (72). Each arm (72) has an extremity (74) connectable to a corresponding joining pin (70) so as to be rotatable around an axis defined by the joining pin (70). It can be easily seen that this purpose may be achieved by either mounting the extremity (74) of the arm (72) rotatably around the joining pin (70), or mounting the joining pin (70) itself rotatably in the pin receiving holes (71). Preferably, the extremity (74) of each arm (72) is provided with a bore (76) for receiving one of the pins (70).

As would be readily understood by a person skilled in the art, the connecting elements (64) may be formed directly by molding during manufacturing of the anchor member (20). In the illustrated embodiment of FIGS. 5 and 6, a protrusion (78) is generated by the molding process on each side of the ridges (66). In the case of corners of a wall where adjacent panels are mounted perpendicularly to each other and where obviously no web member is provided with the connectors, these protrusions, which are embedded in the concrete with the ridges, have the additional advantage of serving as anchor means for the flanges of the connector in which screws could be inserted to fix, for example, a plasterboard wall thereto.

Therefore, thanks to both the relief of the top and bottom sides of the panels (14) and the connectors (16), the wall form assemblies according to the illustrated preferred embodiment of the present invention can be easily stacked over each other and linked together.

Once a form for receiving flowable material is mounted using a plurality of stacked horizontal rows of form wall assemblies, the empty cavity existing between the form wall made of isolating and rigid panels (14) is filled with concrete or with cement based grout. After hardening of the filling material, a composite wall is obtained with the isolating panels firmly attached through the connectors to the concrete inside-wall.

Although a preferred embodiment of the invention has been described in detail herein and illustrated in the accompanying drawings, it is to be understood that the invention is not limited to this precise embodiment and that various changes and modifications may be effected therein without departing from the scope or spirit of the invention.

What is claimed is:

1. A stackable insulating foam panel having a top side and a bottom side each including a single median row of alternating projections and recesses having a similar complementary shape, the median row being disposed between two coplanar edge surfaces, each projection of the top side being opposed to a recess of the bottom side and each recess of the top side being opposed to a projection of the bottom side whereby the top side of the panel is interconnectable with either the top side or the bottom side of a like panel and the bottom side of the panel is interconnectable with either the top side or the bottom side of a like panel.

2. A foam panel according to claim 1, wherein the similar complementary shape of the projections and the recesses is generally rectangular.

3. A foam panel according to claim 2, wherein the projections have rounded-corners.

4. A foam panel according to claim 3, wherein each of the projections and the recesses has two opposite substantially convex lateral sides.

5. A wall form assembly for receiving a flowable material comprising:

a first and a second opposed foam panels in parallel relationship; and a plurality of connectors hingedly tying together the first and second foam panels, whereby the tied foam panels are movable between an extended position where the foam panels are spaced-apart to make the form and a collapsed position where the foam panels are brought close to each other, and wherein each of the first panel and the second panel has a top side and a bottom side each including a single median row of alternating projections and recesses having a similar complementary shape, the median row being disposed between two coplanar edge surfaces, each projection and recess of the top side of one panel being opposed respectively to a recess and a projection of the bottom side of the same panel and facing a recess of the other panel when the panels are in the extended position whereby the panels in the extended position is interconnectable with a like pair of panels.

6. A wall form assembly according to claim 5, wherein the similar complementary shape of the projections and the recesses of each panel is generally rectangular.

7. A wall form assembly according to claim 6, wherein the projections have rounded-corners.

8. A wall form assembly according to claim 7, wherein each of the projections and the recesses has two opposite substantially convex lateral sides.

9. A wall assembly according to claim 5, wherein the connector comprises:

a pair of anchor members, one being devised to be embedded in the first foam panels and the other being devised to be embedded in the second foam panels, each anchor member having:

an elongated flange plate extending longitudinally and deep inside the foam panel; and an elongated link element connected longitudinally to the flange plate and having a projecting end coming out of the foam panel, and a web member extending between the first and the second foam panels, the web member having opposite longitudinal side ends, each of said ends being hingedly connectable to said projecting end of either one of said anchor members;

whereby the foam panels are tied together by connecting one side end of the web member to the projecting end of one of said anchor members and the other side end of the web member to the projecting end of the other anchor member, the tied foam panels being thereby movable between an extended position where the foam panels are spaced-apart to make the form and a collapsed position where the foam panels are brought close to each other.

10. A wall assembly according to claim 9, wherein the projecting end of each anchor member comprises a stabilising plate parallel to the flange plate extending flush with an inner surface of the foam panel.

11. A wall assembly according to claim 10, wherein the projecting end of each anchor member comprises a plurality of connecting elements disposed on the stabilising plate, each connecting element having two aligned ridges projecting from the stabilising plate and defining a longitudinal sleeve therebetween, and a joining pin longitudinally mountable in said sleeve; and each longitudinal side end of the web member defines a plurality of arms for cooperating with each of the connecting elements, each arm having an extremity connectable to the joining pin of a corresponding connecting element so as to be rotatable around an axis defined by said joining pin, thereby allowing the web member and anchor member to pivot with respect to each other.

12. A wall assembly according to claim 11, wherein the ridges of each connecting element each have a pin-receiving hole therein facing inwardly of the sleeve for receiving an end of the joining pin.

13. A wall assembly according to claim 12, wherein the extremity of each arm of the longitudinal side end of the web member has a bore therein to receive the pin.

* * * * *

US006401419C1

(12) EX PARTE REEXAMINATION CERTIFICATE (7413th)

United States Patent

Béliveau

(10) Number: US 6,401,419 C1

(45) Certificate Issued: Mar. 23, 2010

(54) STACKABLE CONSTRUCTION PANEL

(75) Inventor: Jean-Louis Béliveau, Magog (CA)

(73) Assignee: Polyform AGP Inc., Granby (CA)

Reexamination Request:
No. 90/010,180, May 28, 2008

Reexamination Certificate for:

| | |
|---|---|
| Patent No.: | **6,401,419** |
| Issued: | **Jun. 11, 2002** |
| Appl. No.: | **09/598,956** |
| Filed: | **Jun. 22, 2000** |

(30) Foreign Application Priority Data

Feb. 11, 2000 (CA) ..... 2298170

(51) Int. Cl.
*E04B 2/28* (2006.01)

(52) U.S. Cl. ..... 52/592.6; 52/309.12; 52/426; 52/592.1

(58) Field of Classification Search ..... None
See application file for complete search history.

(56) References Cited

U.S. PATENT DOCUMENTS

| | | | | |
|---|---|---|---|---|
| 4,731,968 | A | 3/1988 | Obino et al. | |
| 4,984,969 | A | 1/1991 | Fineberg | 417/58 |
| 5,060,446 | A | 10/1991 | Beliveau et al. | 52/592.1 |
| 5,428,933 | A | 7/1995 | Philippe | |
| 5,839,243 | A | 11/1998 | Martin | 52/439 |
| D429,346 | S | 8/2000 | Martin, Jr. | D25/117 |
| 6,230,462 | B1 | 5/2001 | Beliveau et al. | 52/426 |
| 6,321,496 | B1 * | 11/2001 | Martin, Jr. | 52/364 |
| 6,536,172 | B1 | 3/2003 | Amend et al. | 52/426 |
| 6,820,384 | B1 | 11/2004 | Pfeiffer | 52/426 |

FOREIGN PATENT DOCUMENTS

CA 2298170 8/2001

OTHER PUBLICATIONS

Deposition of Robert Martin, Sr., pp. 1–49, Jul. 8, 2008.
Declaration of Murray Snider, pp. 1–4, Aug. 18, 2008.
Declaration of Jean–Louis Béliveau, pp. 1–4, Jul. 16, 2008.
Merriam Webster's Collegiate Dictionary 10th Ed., pp. 34, 123 and 839, 1997.
Declaration of Greg McAllister in Support of Plaintiff's Opposition to Defendant's Motion for Summary Judgment, pp. 1–3, Jul. 18, 2008.
McAllister Declaration Exhibit A, Excerpts from Patents that Disclose Panels, pp. 1–13, Jul. 17, 2008.
McAllister Declaration Exhibit B, Excerpts from Patents Disclosing Blocks, pp. 1–8, Jul. 18, 2008.
Letter from François Grenier to Victor Amend, President, Amvic Inc., pp. 1–2, Nov. 13, 2003.
Letter from François Grenier to L.E. Trent Horne, Sim Hughes Ashton & McKay, p. 1, Mar. 2, 2004.
Email from François Grenier to François Beauchesne, p. 1, Mar. 24, 2004.
Letter from L.E. Trent Horne, Sim, Hughes, Ashton & McKay to François Grenier, p. 1, Jan. 16, 2004.
Letter from L.E. Trent Horne, Sim, Hughes, Ashton & McKay to François Grenier, pp. 1–3, Dec. 22, 2003.
Letter from L.E. Trent Horne, Sim, Hughes, Ashton & McKay to François Grenier, p. 1, Dec. 11, 2003.
Letter from François Grenier to Roger T. Hughes, Sim, Hughes, Ashton & McKay, p. 1, Dec. 8, 2003.
Letter from François Grenier to Roger T. Hughes, Sim, Hughes, Ashton & McKay, p. 1, Dec. 5, 2003.

(Continued)

*Primary Examiner*—Cary E. O'Connor

(57) ABSTRACT

A stackable insulating foam panel which has a top side and a bottom side. Each of the panels has a median row of alternating projections and recesses with a similar complementary shape. The median row is disposed between two coplanar edge surfaces. Each projection of the top side is opposed to a recess of the bottom side whereby the top side and/or the bottom side of the panel can be interconnected with either the top side or the bottom side of a like panel. The present invention also concerns a wall form assembly which comprises opposed foam panels disposed in parallel relationship to make a wall form for receiving a flowable material such as concrete and a plurality of connectors for tying the opposed foam panels together.

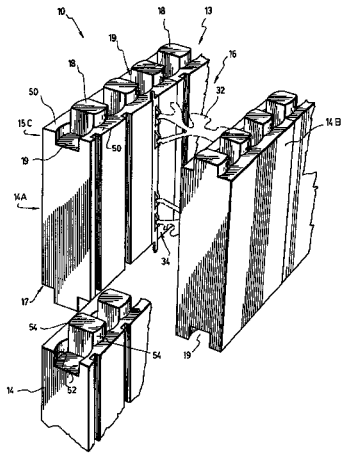

OTHER PUBLICATIONS

Letter from Roger T. Hughes, Sim, Hughes, Ashton & McKay to François Grenier, p. 1, Dec. 3, 2003.
Letter from Peter Biro, G&C to François Grenier, p. 1, Nov. 25, 2003.
Deposition Exhibit 87, pp. 1–8, Aug . 14, 2008.
Deposition Exhibit 85, p. 1, Aug . 14, 2008.
Amvic pictures, p. 1–3.
Supplemental Expert Report of Arthur W. McKinney, pp. 1–3, Aug. 27, 2008.
Expert Report of Jay Crandell, pp. 1–58, Aug. 27, 2008.
Deposition of Arthur W. McKinney, pp. 1–31, Sep. 4, 2008.
Declaration of Jay H. Crandell, pp. 1–2, Aug. 28, 2008.
Deposition of Jay Crandell, pp. 1–88, Sep. 2, 2008.
"Prescriptive Method for Insulating Concrete Forms in Residential Construction," U.S. Department of Housing and Urban Development, pp. 1–200, May 1998.
Exhibit 171 from the Deposition of Jay Crandell, p. 1, Sep. 2, 2008.
"A Candlewood Suites Hotel Under Construction in Omaha Red–tagged by City for Structural Problems; One Engineer Suggests Structure Should be Torn Down," Hotel Online, pp. 1–2, Feb. 28, 2007.
Email from Louis DiSanto to Gloria Martin, pp. 1–2, May 30, 2008.
Claim Construction Order, pp. 1–7, Oct. 15, 2008.
Airlite Plastics Co.'s Memorandum in Support of its Motion for Summary Judgment of Invalidity, dated Jun. 5, 2008, Civil Action No. 8:07–cv–397.
Affidavit of Robert Martin, Jr. in Support of Airlite's Motion for Summary Judgment of Invalidity, dated Jun. 4, 2008, Civil Action No. 8:07–cv–397.
Polyform, A.G.P. Inc.'s Memorandum in Opposition to Defendant's Motion for Summary Judgment, dated Jul. 18, 2008, Civil Action No. 8:07–cv–397.
Airlite Plastics Co.'s Reply in Support of its Motion for Summary Judgment of Invalidity, dated Aug. 1, 2008, Civil Action No. 8:07–cv–397.
Attachment 3, Nudura Corporation Slide Presentation, Airlite Plastics Co.'s in Support of its Motion for Summary Judgment of Invalidity, dated Aug. 1, 2008, Civil Action No. 8:07–cv–397.
Attachment 5, Nudura Corporation Design Specification Manual, Airlite Plastics Co.'s Reply in Support of its Motion for Summary Judgment of Invalidity, dated Aug. 1, 2008, Civil Action No. 8:07–cv–397.
Attachment 6, Nudura Corporation Training Course, Airlite Plastics Co.'s Reply in Support of its Motion for Summary Judgment of Invalidity, dated Aug. 1, 2008, Civil Action No. 8:07–cv–397.
Attachment 7, Nudura Corporation Advertising, Airlite Plastics Co.'s Reply in Support of its Motion for Summary Judgment of Invalidity, dated Aug. 1, 2008, Civil Action No. 8:07–cv–397.
Attachment 8, Reply to Freedom in Information Act (FOIA) Request, Airlite Plastics Co.'s Reply in Support of its Motion for Summary Judgment of Invalidity, dated Aug. 1, 2008, Civil Action No. 8:07–cv–397.

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–3 are cancelled.

New claims 14–25 are added and determined to be patentable.

Claims 4–13 were not reexamined.

*14. A stackable insulating foam panel having*

*a top side and a bottom side each including*

*a single median row of continuous, uninterrupted alternating projections and recesses having a similar complementary shape and extending the entire length of the top and bottom sides,*

*the median row being disposed between two coplanar edge surfaces,*

*the alternating projections extending above and the recesses extending below the coplanar edge surfaces,*

*each projection of the top side being opposed to a recess of the bottom side and each recess of the top side being opposed to a projection of the bottom side*

*whereby the top side of the panel is interconnectable with either the top side or the bottom side of a like panel and the bottom side of the panel is interconnectable with either the top side or the bottom side of a like panel.*

*15. The stackable insulating foam panel of claim 14, further including*

*a substantially flat front face and a substantially flat back face extending between the top and bottom sides and configured to be coupled to a like panel to create a wall form for receiving flowable material and produce a monolithic wall.*

*16. The stackable insulating foam panel of claim 14, further including*

*a substantially flat front face and a substantially flat back face extending between the top and the bottom side, the front and back faces configured such that either the front or the back face of the panel may be stacked in substantial contact with either the front face or back face of a like panel during shipment.*

*17. The stackable insulating foam panel of claim 14, wherein the top side and bottom side each further including*

*the alternating projections and recesses extend an equal distance above or below the coplanar edge surfaces.*

*18. The stackable insulating foam panel of claim 14, wherein for each recess that is between two projections, each recess contains a bottom surface with a peripheral edge and a surface perpendicular to the bottom surface that extends completely around the peripheral edge.*

*19. The stackable insulating foam panel of claim 18, wherein the surface perpendicular to the bottom surface contains four flat sides perpendicular to each adjacent flat side and connected by rounded corners.*

*20. A stackable insulating foam panel having:*

*a top side and a bottom side each including*

*a single median row of alternating projections and recesses extending and repeating the length of the top and bottom sides and having a similar complementary shape wherein no structures intervene between the alternating projections and recesses,*

*the median row being disposed between two coplanar edge surfaces with the projections and recesses extending either above or below the two coplanar edge surfaces,*

*each projection of the top side being opposed to a recess of the bottom side and each recess of the top side being opposed to a projection of the bottom side*

*whereby the top side of the panel is interconnectable with either the top side or the bottom side of a like panel and the bottom side of the panel is interconnectable with either the top side or the bottom side of a like panel.*

*21. A stackable insulating foam panel comprising:*

*a top side and a bottom side each including*

*a single median row of alternating projections and recesses having a similar complementary shape,*

*the median row being disposed between two coplanar edge surfaces,*

*the median row extending the length of the top and bottom sides and having a continuous square wave profile with tops of the projections and bottoms of the recesses being outside a plane defined by the two coplanar edge surfaces,*

*each projection of the top side being opposed to a recess of the bottom side and each recess of the top side being opposed to a projection of the bottom side*

*whereby the top side of the panel is interconnectable with either the top side or the bottom side of a like panel and the bottom side of the panel is interconnectable with either the top side or the bottom side of a like panel.*

*22. The stackable insulating foam panel of claim 21 further comprising:*

*a substantially flat front face and a substantially flat back face extending between the top and bottom sides and configured to be coupled to a like panel to create a wall form for receiving flowable material.*

*23. A stackable insulating foam panel comprising:*

*a top side and a bottom side each including*

*a single continuous median row of uninterrupted alternating projections and recesses at or near the middle of and spaced from the lateral side edges of the panel, with the alternating projections and recesses having a similar complementary shape,*

*the median row extending the length of the top and bottom sides and being disposed between two coplanar edge surfaces, wherein the coplanar edge surfaces border the lateral side edges of the panel and lie substantially in the same plane,*

*the alternating projections having a top surface extending a distance above the coplanar edge surfaces that substantially equals a second distance to a bottom of the recesses that extend below the coplanar edge surfaces,*

*each projection of the top side being opposed to a recess of the bottom side and each recess of the top side being opposed to a projection of the bottom side*

*whereby the top side of the panel is interconnectable with either the top side or the bottom side of a like panel and*

*the bottom side of the panel is interconnectable with either the top side or the bottom side of a like panel.*

*24. The stackable insulating foam panel of claim 23 further comprising:*

*a substantially flat front face and a substantially flat back face extending between the top side and the bottom side, the front and back faces configured such that either the front or the back face of the panel may be stacked in substantial contact with either the front face or back face of a like panel during shipment.*

*25. The stackable insulating foam panel of claim 23 further comprising:*

*a front face and a back face extending between the top side and the bottom side; and*

*a second stackable insulating foam panel connected to either the front face or back face of the panel to form a block for receiving flowable material and produce a monolithic wall.*

* * * * *